United States Patent [19]

Mulligan

[11] 4,435,876

[45] Mar. 13, 1984

[54] FIBER WASTE DISPOSAL SYSTEM FOR TRAVELING PNEUMATIC CLEANERS

[75] Inventor: William L. Mulligan, Charlotte, N.C.

[73] Assignee: Parks-Cramer Company, Fitchburg, Mass.

[21] Appl. No.: 434,115

[22] Filed: Oct. 13, 1982

[51] Int. Cl.[3] ..... A47L 5/38

[52] U.S. Cl. ..... 15/312 R

[58] Field of Search ..... 15/312 R, 312 A, 319

[56] References Cited

U.S. PATENT DOCUMENTS 3,011,925 12/1961 Holtzclaw ..... 15/312 A X 4,333,772 6/1982 Mulligan et al. ..... 15/312 R X

*Primary Examiner*—Chris K. Moore

*Attorney, Agent, or Firm*—Bell, Seltzer, Park & Gibson

[57] ABSTRACT

A plurality of traveling pneumatic cleaners is provided for respective groups of textile machines and cooperates with respective unloading stations for transferring fiber waste from collection chambers of the traveling cleaners and into the unloading stations during unloading cycles actuated at spaced time intervals during operation of the traveling pneumatic cleaners. Suction producing means is connected between all of the unloading stations and a common fiber waste collecting unit and controls are provided for operating the suction producing means only during the unloading cycles, thereby saving energy during the collecting cycles. Controls are also provided for ensuring that each of the active traveling pneumatic cleaners is unloaded during each unloading cycle.

5 Claims, 3 Drawing Figures

FIBER WASTE DISPOSAL SYSTEM FOR TRAVELING PNEUMATIC CLEANERS

FIELD OF THE INVENTION

This invention relates generally to a fiber waste disposal system for systematically removing fiber waste from a plurality of traveling pneumatic cleaners each movable in a path of travel adjacent fiber waste generating textile machines, and more particularly to such a disposal system which includes improved controls providing efficient removal of the fiber waste material from the traveling cleaners while also saving energy.

BACKGROUND OF THE INVENTION

U.S. Pat. No. 4,333,772, assigned to the same assignee as the present application, discloses a fiber waste unloading arrangement for effecting the removal of fiber waste from the collection chambers of a plurality of traveling pneumatic cleaners traveling adjacent respective groups of textile machines by employing a plurality of unloading stations connected to a common source of suction. In the unloading arrangement of said patent, only a single one of the plurality of unloading stations may be actuated at any given time so that it is necessary to provide only a sufficient capacity to provide suction air flow for only a single unloading station, thereby providing a cost savings in both initial expenditure and ongoing energy requirements. However, the motor and fan providing the common source of suction operate continuously, that is, both during the time that a traveling cleaner is being unloaded at one of the unloading stations, as well as during the time between unloading intervals of the traveling cleaners. Since it is usually necessary to unload the fiber waste from the traveling cleaners only one or two times during each eight-hour shift of operation, the continuous operation of the motor and fan providing the common source of suction results in a waste of energy.

Also, the controls of the unloading arrangement disclosed in said patent provide for the unloading of the traveling cleaners in the order in which the traveling cleaners arrive at the respective unloading stations, in what may be termed a "first come, first served" manner. Thus, it is possible for a first traveling cleaner to be in the process of being unloaded at a first unloading station when a second traveling cleaner moves in position at a second unloading station to be unloaded, but this second traveling cleaner will not stop and be unloaded because the first traveling cleaner is being unloaded at the first unloading station. If a third traveling cleaner is being unloaded when the second traveling cleaner again approaches the second unloading station, the unloading of the second traveling cleaner will again be delayed. After the third traveling cleaner is unloaded, if the first traveling cleaner arrives at its respective unloading station before the second traveling cleaner arrives at its unloading station, then the first traveling cleaner would be unloaded again and the second traveling cleaner may again be delayed in being unloaded. Since the unloading of the traveling cleaners can occur only at timed intervals, it is possible that the bypassed second traveling cleaner may not be unloaded during an entire unloading cycle and will become overloaded with waste fibers to the point that it is not possible to completely unload that particular traveling cleaner even during a subsequent unloading cycle.

In the unloading arrangement of U.S. Pat. No. 4,333,772, a timer is provided with each traveling cleaner for providing individual collecting and unloading cycles for each traveling cleaner. Thus, while correlation between the unloading cycles is attempted, the unloading cycle of a certain traveling cleaner may occur at a different time interval than the unloading cycle of one or more of the other traveling cleaners.

SUMMARY OF THE INVENTION

With the foregoing in mind, it is an object of the present invention to provide an improved fiber waste disposal system for traveling cleaners in which the motor and fan providing the common source of suction are operated only during an unloading cycle, thereby saving the energy normally expended by the operation of the motor and fan during the fiber waste collecting cycle.

It is another object of the present invention to provide a fiber waste disposal system in which the unloading of the traveling cleaners is properly sequenced so that all operating traveling cleaners are unloaded during each unloading cycle. The waste disposal system also includes means for skipping the normal sequence of unloading of a particular traveling cleaner, should that particular traveling cleaner be out of service during a particular unloading cycle.

The fiber waste disposal system of the present invention includes control means for controlling operation of the traveling cleaners in respective fiber waste collecting and unloading cycles. This control means preferably includes a common timer means for initiating each unloading cycle for all of the then active traveling cleaners during which unloading of fiber waste from the respective traveling cleaners is accomplished. The control means includes deactivating means for terminating each unloading cycle after all active traveling cleaners have been unloaded and for initiating each fiber waste collecting cycle. It is also preferred that the control means be provided with suitable controls for initially unloading all of the traveling cleaners upon the initial starting of the fiber waste cleaning system. A suitable time delay means is also provided for continued operation of the motor and fan providing the common source of suction for a short period of time after the fiber waste material has been unloaded from the last traveling cleaner during an unloading cycle so as to remove any of the fiber waste from the ducts connecting the plurality of unloading stations to the common waste collecting unit.

BRIEF DESCRIPTION OF THE DRAWINGS

Some of the objects of the invention having been stated, other objects and advantages will appear as the description proceeds when taken in connection with the accompanying drawings, in which.

DESCRIPTION OF THE ILLUSTRATED EMBODIMENT

Figure 1:
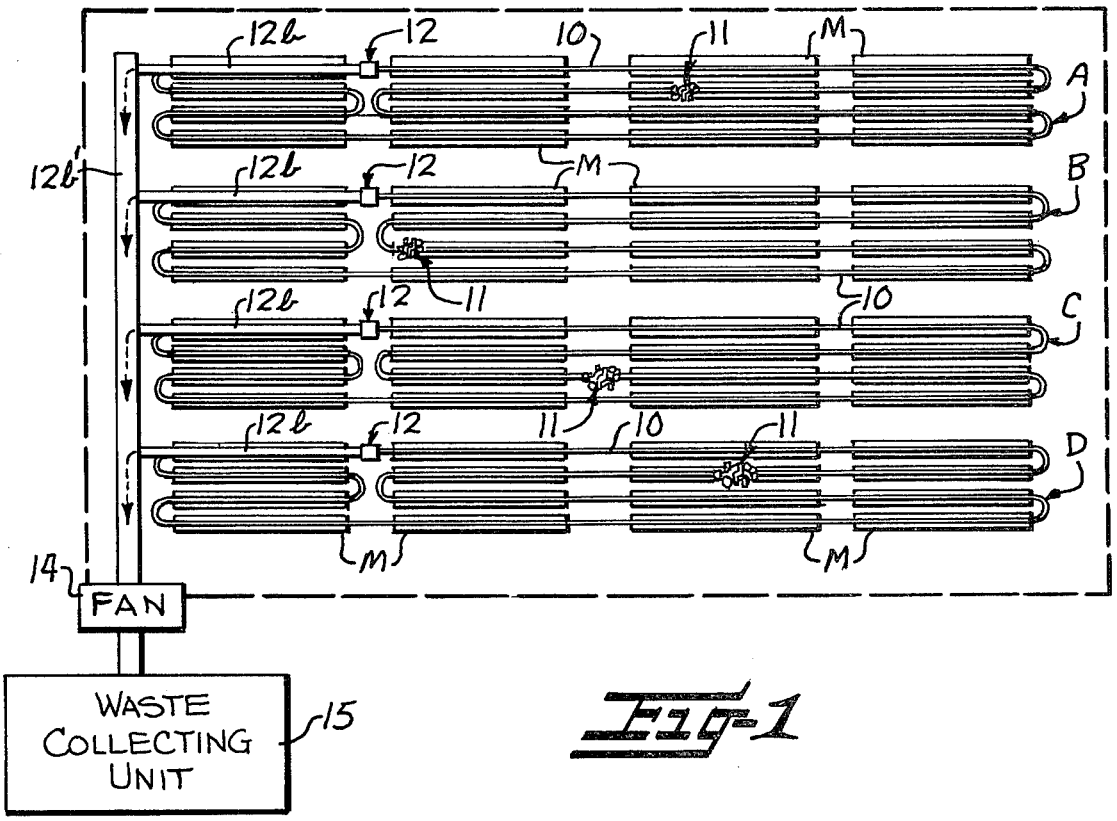
FIG. 1 is a schematic plan view of groups of textile machines in a textile room illustrating an arrangement of a plurality of traveling pneumatic cleaners and corresponding unloading stations for disposal of waste fiber into a central collecting unit.

The traveling pneumatic cleaners and the fiber waste disposal system illustrated in the drawings of the present application are of generally the same type as disclosed in the aforesaid U.S. Pat. No. 4,333,772. The disclosure in said patent is hereby incorporated in the present application by reference, to the extent necessary to clearly understand the present invention.

FIG. 1 illustrates a typical textile mill room in which groups A–D of fiber waste generating textile machines M, such as looms, spinning frames, twisters and the like are arranged in spaced parallel rows. Four longitudinal rows with four machines M in each row are illustrated by way of example only in each of the four groups A, B, C and D and an endless track 10 extends over the machine rows in each group. A respective traveling pneumatic cleaner 11 is movable along the track 10 for each textile machine group A–D. Thus, a traveling pneumatic cleaner 11 is movable along a predetermined path of travel defined by a respective track 10 adjacent each of the respective groups A–D of textile machines.

The tracks 10 may be endless, as shown, or they may be double-ended, since traveling pneumatic cleaners currently in use in the textile industry generally are equipped with reversing means for reversing the direction of travel of the cleaner at opposite ends of its traverse along a double-ended track and/or at any point in its travel upon the traveling cleaner engaging an obstruction in its path, as is well known.

In any event, since the traveling pneumatic cleaners 11 are movable along respective individual tracks, desirably an individual unloading station means 12, referred to hereinafter as an "unloading station," is provided adjacent each track 10 for receiving and disposing of fiber waste from at least one fiber waste collection chamber on a respective traveling cleaner 11, which fiber waste is collected in the collection chamber as it is being picked up by suction from the floor and/or machine surfaces incidental to the travel of each traveling cleaner along the respective group of machines. For the sake of economony in manufacture and maintenance, as well as economy and efficiency in the use of energy, all the unloading stations 12 are connected to a common source of suction, such as an electric motor and fan, indicated at 14, and all of the fiber waste is deposited in a common waste collection unit 15.

In the description which follows, only that traveling pneumatic cleaner 11, that unloading station 12 and that control unit A′ associated with the machine group A will be described in detail, it being understood that all traveling cleaners 11 and all of the unloading stations 12 in FIG. 1 may be of essentially the same construction. Also, the control units A′–D′ are interconnected so that during the transfer of fiber waste from any one of the traveling pneumatic cleaners 11 into a respective unloading station 12, the respective then active control unit renders inoperative those control units associated with all the other unloading stations 12. Since the valve means of only one of the unloading stations 12 would be open to the flow of air therethrough to the suction source at any given time, it can be understood that the capacity of the suction source at the waste collection unit 15 may be relatively small.

The traveling pneumatic cleaner 11 (FIG. 2) includes a housing 20 supported on a motor-driven wheeled carriage, not shown, mounted for movement on the track 10. The housing 20 includes downwardly depending flexible blowing tubes 21 and flexible suction tubes 22. The upper ends of the suction tubes 22 communicate with suitable air impeller means, not shown, in the housing 20 for depositing fiber waste from the suction tubes 22 into respective front and rear fiber waste collection chambers or canisters 26, 26′. Although the traveling pneumatic cleaner 11 is illustrated as being equipped with two collection chambers, it may be equipped with a single chamber or more than two collection chambers.

The collection chambers 26, 26′ are provided with respective normally closed discharge doors 27, 27′ located adjacent the respective front and rear ends of the housing 20. The door 27 is shown in an open position while the door 27′ is shown in a closed position in FIG. 2. Actuating followers 32, 32′ are connected by linkage to the respective doors 27, 27′ and an operating cam 35 is located adjacent the mouth of the unloading station 12 and normally occupies an inactive raised position out of the path of travel of the followers 32, 32′ on the respective traveling pneumatic cleaner 11. However, when the cam 35 is lowered to an active position, as shown in FIG. 2, by means to be later described, the followers 32, 32′ successively engage the cam 35 which is so shaped as to displace the followers 32, 32′ from their normal positions and thereby swing the respective doors 27, 27′ to the open position, as shown in the left-hand portion of FIG. 2.

As shown in FIG. 1, the unloading stations 12 are each provided with an elongate duct **12*b* connected at one end to a common duct 12*b*′ which is in turn connected to the motor and fan 14 forming the single source of suction for drawing the fiber waste into the common waste collecting unit 15. The duct 12*b* of each unloading station 12 (FIG. 3) is provided with a normally closed valve 12*c* interposed therein. The valve 12*c* is in the form of a gate valve movable between its normally closed position and a fully opened position by means of a fluid cylinder 12*d* for controlling the flow of suction air into the unloading station 12**.

The cylinder **12*d* forms a part of the control means for effecting opening of the valve means 12*c* of the unloading station 12 and the door means 27, 27′ of the respective traveling cleaner 11 upon only certain occasions of movement of the traveling cleaner into proximity to the respective unloading station 12. The control means also includes a carrier 40 supported for vertical movement adjacent the loading station 12 (FIG. 3) and being movable between the raised inactive position shown in FIG. 3, and a lowered active position. The carrier 40 is raised and lowered by means of a fluid cylinder 50 and the cam 35 for operating the doors 27, 27′ is supported on the carrier 40. Sensor switches 54, 54′ (FIG. 3) are supported forwardly and rearwardly of the unloading station 12 and are positioned to be tripped by the traveling pneumatic cleaner 11 as it moves past the respective unloading station 12**.

Figure 2:
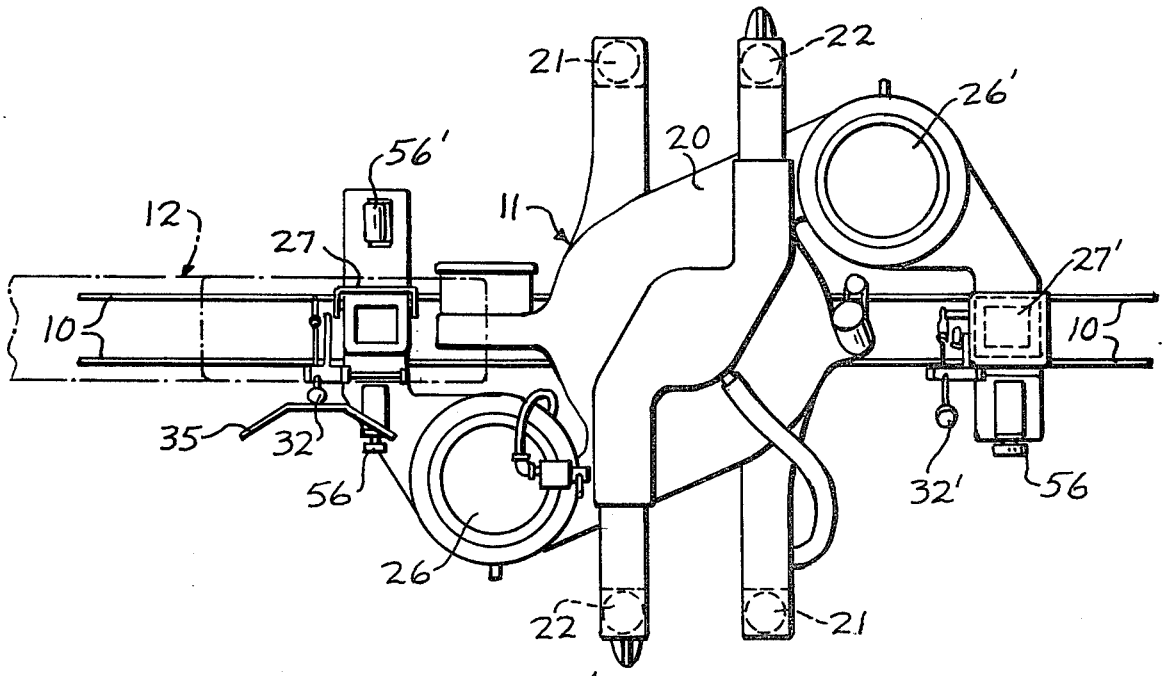
FIG. 2 is an enlarged top plan view of one of the traveling pneumatic cleaners of FIG. 1 and with the leading end of the traveling cleaner being positioned under one of the unloading stations, illustrated in dash-dot lines.

As shown in FIG. 2, the traveling cleaner 11 includes two spaced rollers 56 on one side and a roller 56′ on the opposite side. The rollers 56, 56′ are used to stabilize the traveling cleaner 11 as they engage stabilizing tracks, not shown, at the unloading station 12. The roller 56′ also acts as an actuator for the sensor switches 54, 54′, for purposes to be presently described. As the traveling cleaner 11 moves forwardly, from right to left in FIG.

3, the roller 56′ successively engages the sensor switches 54, 54′. When the cleaner 11 moves rearwardly, the roller 56′ successively engages the switches 54′, 54. The switches 54, 54′ thus serve as respective means for, at times, sensing direction of movement of the traveling cleaner 11 in proximity to the unloading station 12, for purposes to be presently described.

Figure 3:
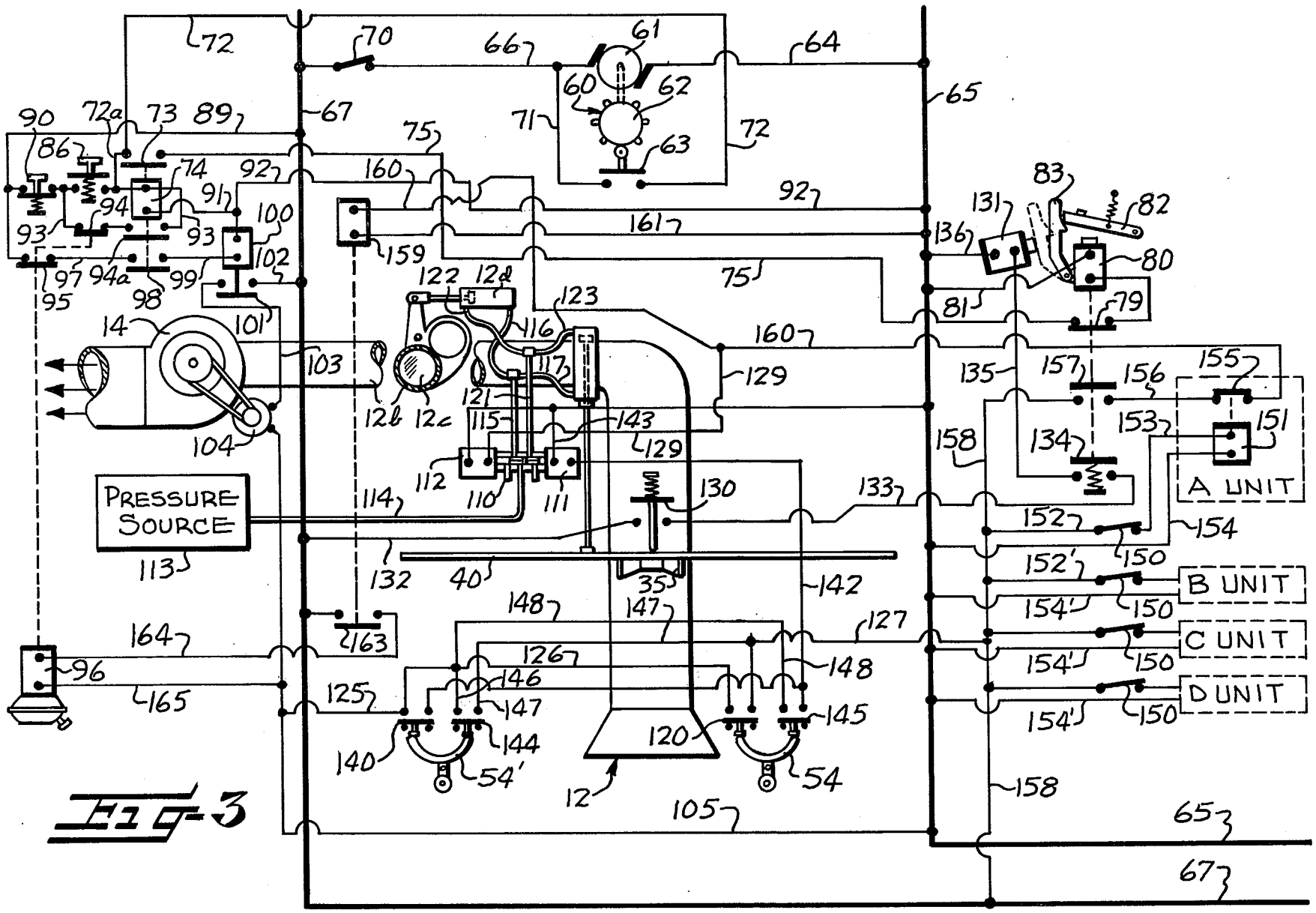
FIG. 3 is a schematic diagram of an electrical circuit of the type associated with the control means at each of the unloading stations and illustrating the control for the motor and fan providing the single source of suction.

As illustrated in FIG. 3, the control means for the fiber waste disposal system of this invention includes a main timer, broadly indicated at 60, which operates to initiate unloading cycles at spaced time intervals. The timer 60 includes a motor 61 and an operating wheel 62 which rotates when the motor 61 is actuated. As illustrated, the timer 60 is a 24-hour clock, that is, the wheel 62 rotates one complete revolution in each 24 hours, as long as the motor 61 is operating. There are six actuating lugs on the wheel 62 so that a switch 63 is closed each four hours of operation of the system. However, it should be understood that any suitable timer means may be used with either fixed or adjustable time intervals.

The motor 61 is driven by means of a connector wire 64 extending to a main lead line 65, and a wire 66 extending to a main lead wire 67, with a manual switch 70 interposed therein. As long as the manual switch 70 is closed, the circuit is completed to the electric motor 61 and the wheel 62 will rotate very slowly and make one complete revolution during each 24-hour time period.

Each time that one of the lugs on the wheel 62 engages and closes the switch 63, an electrical circuit will be completed to initiate an unloading cycle, during which all traveling cleaners 11 in service will have the fiber waste therein removed at the respective unloading station 12. The circuit is completed through wires 71, 72, 72*a*, the coil of a relay 74, and wires 91, 92 to main lead wire 65. This energizes relay 74 to close switch 73 to complete a circuit through wire 71, switch 63, wire 72, switch 73, wire 75, switch 79, the coil of a latching relay 80, and wire 81 to the main lead wire 65. Thus, at the beginning of each unloading cycle, the latching relay 80 associated with each of the traveling cleaners 11 is actuated by downward movement of a pivoted arm 82 and inward movement of a latching finger 83. Each of the latching relays 80 will remain in a latched condition until the corresponding traveling cleaner 11 moves under an unloading station 12 and the fiber waste is unloaded therefrom. While this particular latching relay is illustrated, it should be understood that any suitable latching switch means may be employed.

As each unloading cycle is initiated by the closing of the switch 63 by the timer 60 and energization of relay 74, operation of the motor and fan 14 begins and this is accomplished by an electrical circuit which is activated by energization of relay 74 which closes switch 98. This completes the circuit through the wire 89, switch 95, a wire 97, switch 98, a wire 99, the coil of relay 100, and wire 92 connected to the main lead 65. A holding circuit is provided for relay 74 by a wire 93 and switches 94 and 94*a*.

Completion of the circuit through relay 100, closes a switch 101 to complete a circuit to the motor 104 of the fan 14 by wire 102, switch 101, wire 103, motor 104 and wire 105 which is connected to the main lead 65. Thus, during each unloading cycle, the fan 14 and motor 104 are started by the timer 60, through energization of relays 74, 100 and will run until the last active traveling cleaner 11 has been unloaded, at which time the fan 14 and motor 104 will be stopped in a manner to be presently described. The fan 14 and motor 104 will not operate again until the next unloading cycle. All of the active traveling cleaners 11 are also unloaded upon initial start-up. Start-up is accomplished by closing push switch 86 to complete a circuit to relay 74 to initiate an unloading cycle the same as if switch 63 were closed.

At the beginning of each unloading cycle, the suction valve 12*c* is maintained in the closed position shown in FIG. 3 and the carrier 40 is maintained in the inactive raised position by the respective cylinders 12*d* and 50. Fluid pressure to the cylinders 12*d* and 50 is controlled by a selector valve 110 having solenoid control coils 111 and 112 at opposite ends thereof. Pressurized fluid is supplied by a pressure source 113 and passes through a main supply line 114 to one side of the selector valve 110. The selector valve 110 is shown in FIG. 3 with its control piston shifted to the right so that the fluid passes through the valve 110 and into a supply line 115 which is connected to branch lines 116, 117 connected to the respective cylinders 12*d* and 50. Thus, at the beginning of each unloading cycle, the suction valve 12*c* is maintained in the closed position shown in FIG. 3 while the carrier 40 is maintained in the upper inactive position shown in FIG. 3.

When the traveling cleaner 11 approaches the unloading station 12, the roller 56′ will engage the actuator of the switch 54 and move it in a clockwise direction to close a contact 120 thereby completing an electrical circuit to the coil 112 to shift the operating piston of the valve 110 to the left in FIG. 3 so that the fluid passes through a supply line 121 and branch lines 122, 123 to the respective cylinders 12*d* and 50. The cylinder 12*d* opens the valve 12*c* so that suction enters the unloading station 12 and the cylinder 50 lowers the carrier 40 to the lower active position. The electrical circuit is completed to the coil 112 by wires 125, 126, switch 120, a wire 127, a wire 158, switch 157, wire 156, switch 155, wire 160, wire 129, the coil 112, and wire 128 connected to the main lead wire 65.

As the traveling cleaner 11 moves beneath the unloading station 12, the operating follower 32 engages the cam 35 and opens the door 27 to the leading or forward chamber 26 so that the fiber waste therein is withdrawn therefrom and passes into the unloading station 12 and through the ductwork to the waste collecting unit 15. When the carrier 40 is lowered to the active operative position, a switch 130 is closed to complete a circuit to an unlatching relay 131 by means of wires 132, 133, a switch 134 held closed by latching relay 80, a wire 135 and a wire 136 connected to the main lead wire 65.

After the chamber 26 is unloaded, the traveling cleaner 11 again moves forwardly and the door 27′ is opened so that the fiber waste is withdrawn from the rear chamber 26′. With further forward movement of the traveling cleaner 11, the roller 56′ engages the sensor switch 54′ to complete the electrical circuit to the coil 111 through the wire 125, a switch 140, wire 141, wire 142, the coil 111, a wire 143, and the wire 128 to the main lead 65. The coil 111 causes the selector valve 110 to be shifted back to the position shown in FIG. 3 so that fluid pressure causes the cylinder 12*d* to close the suction valve 12*c* and the cylinder 50 to raise the carrier 40 to the upper inactive position. The operation of the unlatching relay 131 draws the latch finger 83 to the dotted line position shown in FIG. 3, thereby releasing the latching relay 80 and opening switches 157 and 134 so that the suction valve 12*c* and cylinder 50 cannot again be operated until all operating traveling cleaners 11 have been unloaded.

If the traveling cleaner 11 should be traveling from right to left in FIG. 3, switches 144, 145 are provided on the respective sensor switches 54', 54. The switch 144 completes an electrical circuit through the wire 125, a wire 146, a wire 147 which is connected to the wire 127 to energize the coil 112 and to cause the suction valve 12c to open and to lower the carrier 40, in the same manner as the switch 120 energizes the coil 112. The switch 145 completes an electrical circuit to the coil 111 through the wire 125, a wire 148, and the wires 142, 143, and 128 to cause the suction valve 12c to close and to raise the carrier 40.

As each of the active traveling cleaners 11 is unloaded, the corresponding unlatching relay 131 is operated so that that particular traveling cleaner will not be unloaded again during that particular unloading cycle. Also, while a particular traveling cleaner 11 is being unloaded, and its corresponding carrier 40 is in a lowered position, suitable limit switches (not shown) connected in the control circuit for suction valve 12c and cylinder 50 of each of the remaining traveling cleaner unloading stations are opened to ensure that only one of the traveling cleaners 11 is unloaded at a time.

Each traveling cleaner 11 is provided with a manual switch 150 which is connected to a relay 151 by wires 152 and 153 and a wire 154 connects the relay 151 to the main lead wire 65. Thus, when the switch 150 on one of the cleaning units 11 is opened, normally when that particular cleaning unit is out of service for one reason or another, the electrical circuit associated with that particular cleaning unit is deactivated by relay 151 opening the normally closed switch 155 so that that particular circuit is not operative while that particular traveling cleaner 11 is out of service.

If an unloading cycle occurs while that particular traveling cleaner is out of service, it will merely be skipped in the sequence of unloading and will be unloaded during the next unloading cycle in which that particular traveling cleaner is in service. One side of the switch 155 is connected to the main lead wire 67 by the wire 156, switch 157 and the wire 158. The other side of each of the switches 155, associated with each of the units A–D, is connected in parallel to one side of a relay 159 by the wire 160. The other side of the relay 159 is connected to the main lead wire 65 by a wire 161. Thus, when the switches 155, 157 of all the units A–D are opened, the relay 159 is energized.

When the relay 159 is energized, a switch 163 is closed to complete the circuit from the lead wire 67 and through a wire 164 connected to the off delay relay 96. The relay 159 is illustrated as an instantaneous relay but may be of the time delay type to ensure that all of the latching relays 80 of the traveling cleaners are activated for a sufficient time for positive latching to occur. A wire 165 is connected from the off delay relay 96 to the wire 105 of the fan control circuit so that the fan 14 continues to run for a minute or so after all units have been unloaded to clear the waste fiber from the last traveling cleaner 11 and from the conveying ductwork 12b and 12b'. After all active traveling cleaners 11 have been unloaded, the operation of the fan 14 is terminated by opening of the switches 95, 94 so that relays 74 and 100 are deenergized and the switch 101 is opened and a collecting cycle begins which continues until the timer 60 again starts an unloading cycle.

Thus, the individual control means for the respective unloading stations is only operative during an unloading cycle for effecting removal of fiber waste from the respective traveling cleaners only upon the first movement of the traveling cleaner into proximity to the respective unloading station. Timer means is provided for initiating an unloading cycle at predetermined time intervals and during which unloading cycle the removal of fiber waste from the traveling cleaners is accomplished. Actuating means is operatively associated with the suction producing means and the timer means for stopping operation of the suction producing means during the duration of the collecting cycle and for operating the suction producing means during the unloading cycle while the traveling cleaners are being unloaded.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. In a fiber waste disposal system for a texile room containing a plurality of groups of fiber waste generating textile machines and having a plurality of traveling pneumatic cleaners each movable in a predetermined path of travel adjacent a respective group of textile machines for removing fiber waste from the textile machines, each traveling cleaner having at least one collection chamber thereon for collecting fiber waste therein, a plurality of unloading station means corresponding in number to the number of traveling pneumatic cleaners with an unloading station means being mounted adjacent the path of travel of each respective traveling cleaner for removing fiber waste from the collection chamber of the respective traveling cleaner during a portion of its travel along said path, a fiber waste collection unit connected to said plurality of unloading station means for receiving fiber waste therefrom, suction producing means connected to said plurality of unloading station means and said collection unit for removing fiber waste from the collection chambers of respective traveling cleaners and for transporting such fiber waste from the unloading station means to said collection unit, control means operatively associated with said traveling cleaners and said unloading station means for controlling the operation of said traveling cleaners to provide a fiber waste collecting cycle and a fiber waste unloading cycle, said control means including cooperating means carried by each unloading station means and its associated traveling cleaner for effecting fiber waste unloading of each traveling cleaner during each unloading cycle, the improvement therein comprising said control means further including deactivating means operatively associated with each of said cooperating means for deactivating said cooperating means upon unloading of the associated traveling cleaner to ensure that said traveling cleaners are unloaded only once during each unloading cycle.

2. In a fiber waste disposal system according to claim 1 wherein said control means includes actuating means operatively associated with said suction producing means for activating said suction producing means only during the predetermined duration of said unloading cycle.

3. In a fiber waste disposal system according to claim 1 wherein said control means includes timer means operable to initiate said unloading cycle, and wherein said deactivating means is operable to terminate said unloading cycle after the last active traveling cleaner has been unloaded.

4. In a fiber waste disposal system for a texile room containing a plurality of groups of fiber waste generating textile machines and having a plurality of traveling pneumatic cleaners each movable in a predetermined path of travel adjacent a respective group of textile machines for removing fiber waste from the textile machines, each traveling cleaner having at least one collection chamber thereon for collecting fiber waste therein, a plurality of unloading station means corresponding in number to the number of traveling pneumatic cleaners with an unloading station means being mounted adjacent the path of travel of each respective traveling cleaner for removing fiber waste from the collection chamber of the respective traveling cleaner during a portion of its travel along said path, a fiber waste collection unit connected to said plurality of unloading station means for receiving fiber waste therefrom, suction producing means connected to said plurality of unloading station means and said collection unit for removing fiber waste from the collection chambers of respective traveling cleaners and for transporting such fiber waste from the unloading station means to said collection unit, control means operatively associated with said traveling cleaners and said unloading station means for controlling the operation of said traveling cleaners to provide a fiber waste collecting cycle and a fiber waste unloading cycle, said control means including cooperating means carried by each unloading station means and its associated traveling cleaner for effecting fiber waste unloading of each traveling cleaner during each unloading cycle, the improvement therein comprising said control means further including actuating means operatively associated with said suction producing means for activating said suction producing means only during the predetermined duration of said unloading cycle.

5. In a fiber waste disposal system according to claim 4 wherein ductwork is provided for connecting said unloading station means to said fiber waste collection unit, and wherein said control means includes time delay relay means for continuing operation of said suction producing means for a predetermined period of time after each of said unloading cycles to remove fiber waste from the collection chamber of the last traveling cleaner to arrive at the corresponding unloading station means upon termination of each of said unloading cycles, and to remove fiber waste from said ductwork connecting said unloading station means to said fiber waste collection unit.

* * * * *